US005588240A

United States Patent [19]

Zilliox

[11] Patent Number: 5,588,240

[45] Date of Patent: Dec. 31, 1996

[54] INTERLOCKING PICTURE FRAME

[76] Inventor: Kent Zilliox, 361 Halsey Ave., San Jose, Calif. 95128

[21] Appl. No.: 215,094

[22] Filed: Mar. 18, 1994

[51] Int. Cl.[6] ..... G09F 1/12

[52] U.S. Cl. ..... 40/729; 40/757; 40/605

[58] Field of Search ..... 40/152, 605, 729; 273/157 R; 428/33

[56] References Cited

U.S. PATENT DOCUMENTS

| | | | |
|---|---|---|---|
| 3,673,723 | 7/1972 | Lazar et al. | 40/152.1 |
| 4,319,419 | 3/1982 | Traill | 40/152.1 |
| 4,432,152 | 2/1984 | Daenen | 40/152.1 |
| 4,529,385 | 7/1985 | Reiner et al. | 273/157 R X |
| 4,532,727 | 8/1985 | Klose et al. | 40/152 |
| 4,608,770 | 9/1986 | Gray | 40/152 |
| 4,912,863 | 4/1990 | Harvey | 40/152 |
| 5,190,287 | 3/1993 | Ishiyama | 273/157 R X |

OTHER PUBLICATIONS

"Cut'em out, stick'em up: magnetic frames for fridge art", Sunset Magazine, Mar. 1994, p. 105.

Magnetic Collage Frame, Paragon Catalog.

Magnetic Puzzle; The One, The Only, The Original Jigsaw Puzzle Book; Sabin, Francene; p. 21; 1977.

Jigsaw Frame, p. 28, Exposure Catalog, Fall Preview 1989.

*Primary Examiner*—Kenneth J. Dorner
*Assistant Examiner*—Cassandra Davis
*Attorney, Agent, or Firm*—James J. Leary; Carol D. Titus

[57] ABSTRACT

A modular picture frame system with the individual picture frames interconnecting like jigsaw puzzle pieces. Each of the puzzle piece-shaped picture frames has male and female connectors in the form of an interlocking geometric shape. These connectors are used to attach the individual frames to one another to make a collage of picture frames. Preferably, each frame is made with multiple connectors facing in different directions so that each frame can be connected with as many other frames as it has connectors. The connectors disclosed include rounded lobe-shaped connectors, dovetail connectors and polygonal geometric connectors. The frames themselves and the display openings in the frames can be virtually any geometric shape, rectangle, diamond, octagon, triangle, circle, or other curved shapes as long as the male and female connectors have sufficient clearance to connect.

15 Claims, 11 Drawing Sheets

INTERLOCKING PICTURE FRAME

FIELD OF INVENTION

The present invention relates to picture frames. More particularly, it relates to a picture frame system in which multiple picture frames can be interlocked with one another allowing the user to choose the number of pictures displayed and the shape of the assemblage of pictures and to add or delete picture frames from the assemblage one-by-one.

BACKGROUND OF THE INVENTION

There are many picture frames on the market which allow for a collage of pictures. Typically these frames include a mat with multiple apertures for displaying a specific number of photographs. These frames are inflexible because they have a predetermined number and arrangement of pictures. Pictures cannot be easily added or deleted from the arrangement. If, for example, a new child or grandchild is added to the family, a picture must be removed from the frame to include the new child, or a new frame is started that has only one or two pictures in it.

Another alternative is shown in U.S. Pat. No. 4,319,419 granted to Traill. Traill shows a support member which is attached to the wall and from which pictures are hung. The support member has four connectors along its bottom edge which allows the photos to be hung in one or two columns. This allows only a limited arrangement of the photos. The most creative arrangement shown by Traill is an inverted pyramid of three picture frames with two frames attached directly to the support member and one below bridging the two columns to form an intermediate column. There is no allowance for lateral expansion of the arrangement pattern.

U.S. Pat. Nos. 4,432,152 to Daenen and 4,912,863 to Harvey show a modular frame which may be connected to other frames. However, these frames require a connecting bar to run along behind the connected frames. This adds another piece which may be lost or misplaced during the time before a picture is added. These methods are complicated and require some concerted effort to attach the pictures to one another. Each of the connectors in these systems are relatively complicated, thereby adding to the cost to the system. Additionally, when these systems are put together they look like what they are, a set of individual frames which have been attached. Gluing two ordinary frames together would have the same visual effect.

SUMMARY OF THE INVENTION

In keeping with the foregoing discussion, the objective of the present invention is to provide a picture frame system that allows the user to arrange multiple frames in a variety of patterns, thereby allowing the user to arrange the frames in what they consider an appealing design. One aspect of this objective is to make the frames so that the arrangement pattern can be expanded in all directions.

It is also an objective of the current invention to provide a picture frame including a simple connection mechanism which is integral with the frame, in this manner, providing an inexpensive yet easily adjustable system of interlocking frames.

It is a further objective of the current invention to provide a picture frame system which has an appealing final appearance. More specifically, making the interlocking feature a part of the overall frame design.

In keeping with these objectives, the present invention takes the form of a modular picture frame system with the individual frames interconnecting like jigsaw puzzle pieces. Each of the puzzle piece-shaped picture frames has male and female connectors in the form of an interlocking geometric shape. These connectors are used to attach the individual frames to one another to make a collage of picture frames. Preferably, each frame is made with multiple connectors facing in different directions so that each frame can be connected with as many other frames as it has connectors. The frames themselves and the openings in the frames can be virtually any geometric shape, rectangle, diamond, octagon, triangle, circle, etc. Other curved shapes may also be used if the male and female connectors have sufficient clearance to connect. Other objects and advantages of the invention will no doubt occur to those skilled in the art upon reading and understanding the following detailed description along with the accompanying drawings.

DETAILED DESCRIPTION OF THE INVENTION

Figure 1:
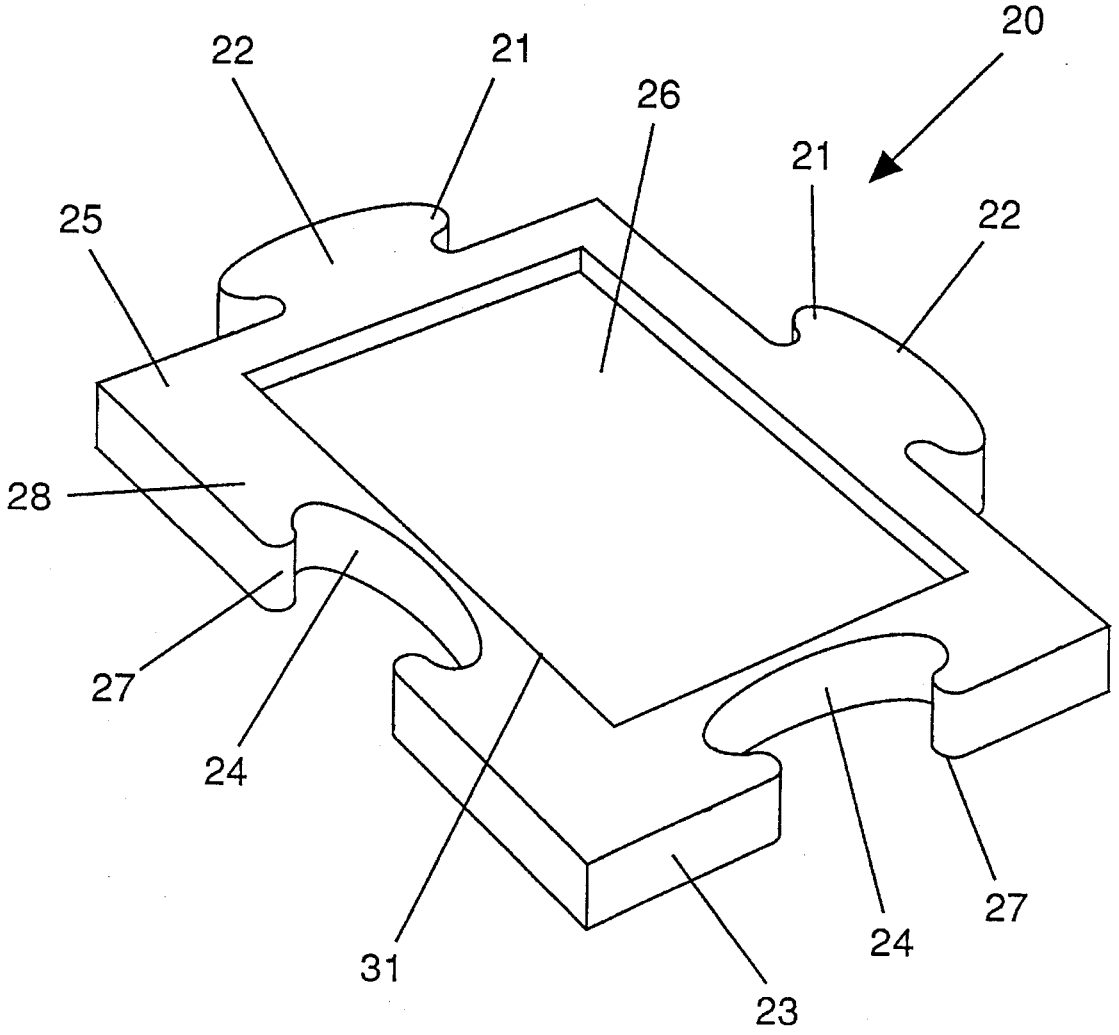
FIG. 1 is a top front perspective view illustrating one embodiment of the interlocking picture frame.

FIG. 1 is a top front perspective view illustrating the first embodiment of the interlocking picture frame 20. In this embodiment, the assembled frame 20 is shaped like a jigsaw puzzle piece with rounded lobe-shaped connectors 22, 24. The frame body 28 is generally rectangular in shape and has two male connectors 22 and two female connectors 24 formed integrally with the frame body 28. Each of the lobe-shaped male connectors 22 is shaped to fit into the female connector 24 of an adjoining picture frame, thereby interlocking the two frames together. The peripheral wall 23 of the frame, which extends all the way around the frame body 28, and follows the contours of each of the male 22 and female 24 connectors, should be of uniform height and approximately perpendicular to the front face 25 of the frame body 28. This allows two frames to be easily slid together to interlock like pieces in a jigsaw puzzle. It also insures that two adjacent frames will fit snugly together with their front faces 25 flush with one another and without any unsightly gaps between them. The female connector 24 has a narrow throat 27 which interlocks with a narrow neck 21 on the male connector 22 to lock the frames securely together. If desired, the male 22 and female 24 connectors can be made with a slight interference fit with one another or with molded-in detents to form an even more secure attachment between frames. Within the frame body 28 is a display recess 31 for holding a picture which is then covered by a protective cover 26.

Figure 2A:
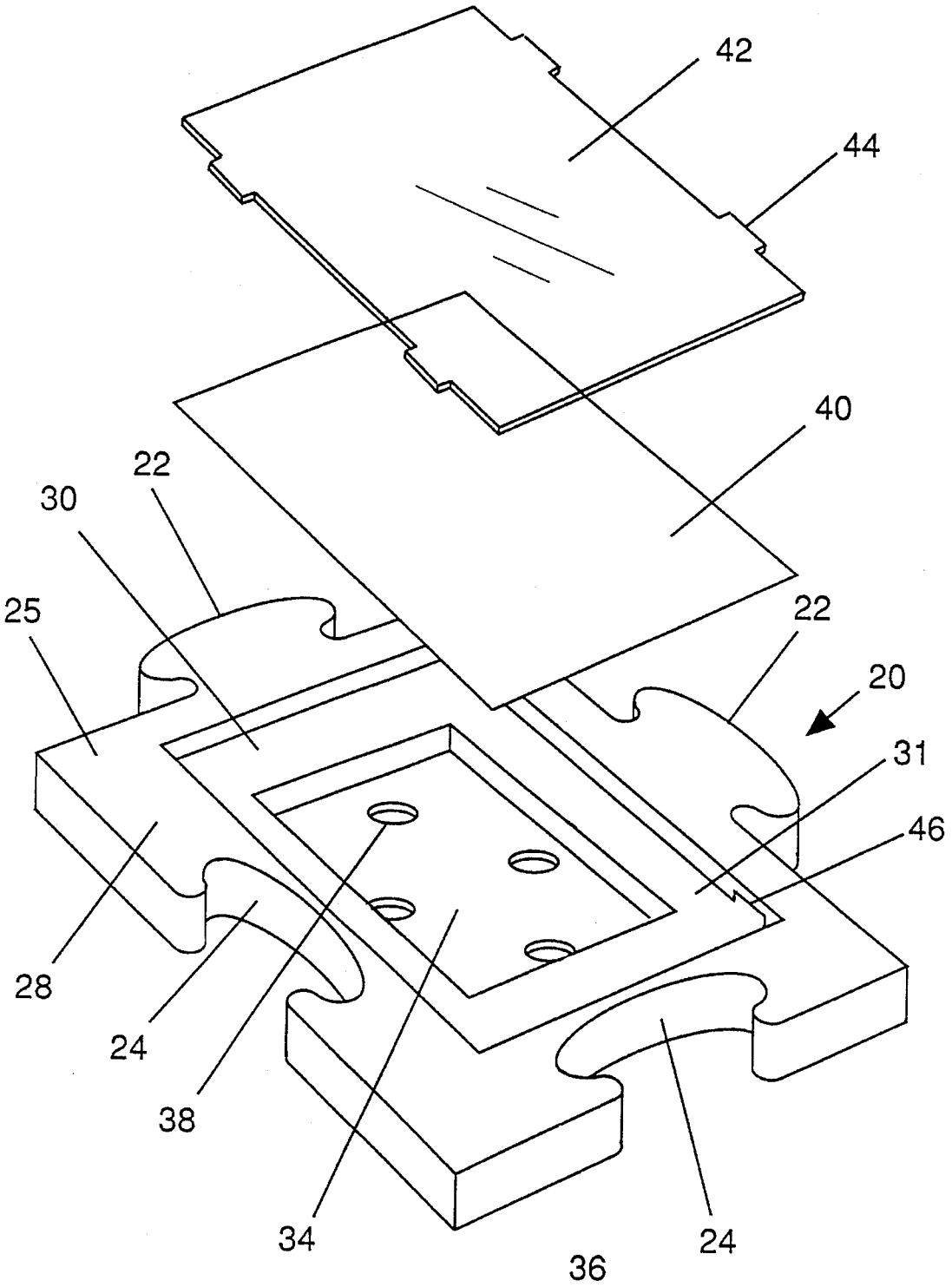
FIGS. 2A and 2B show exploded views of the picture frame in FIG. 1.
Figure 2B:
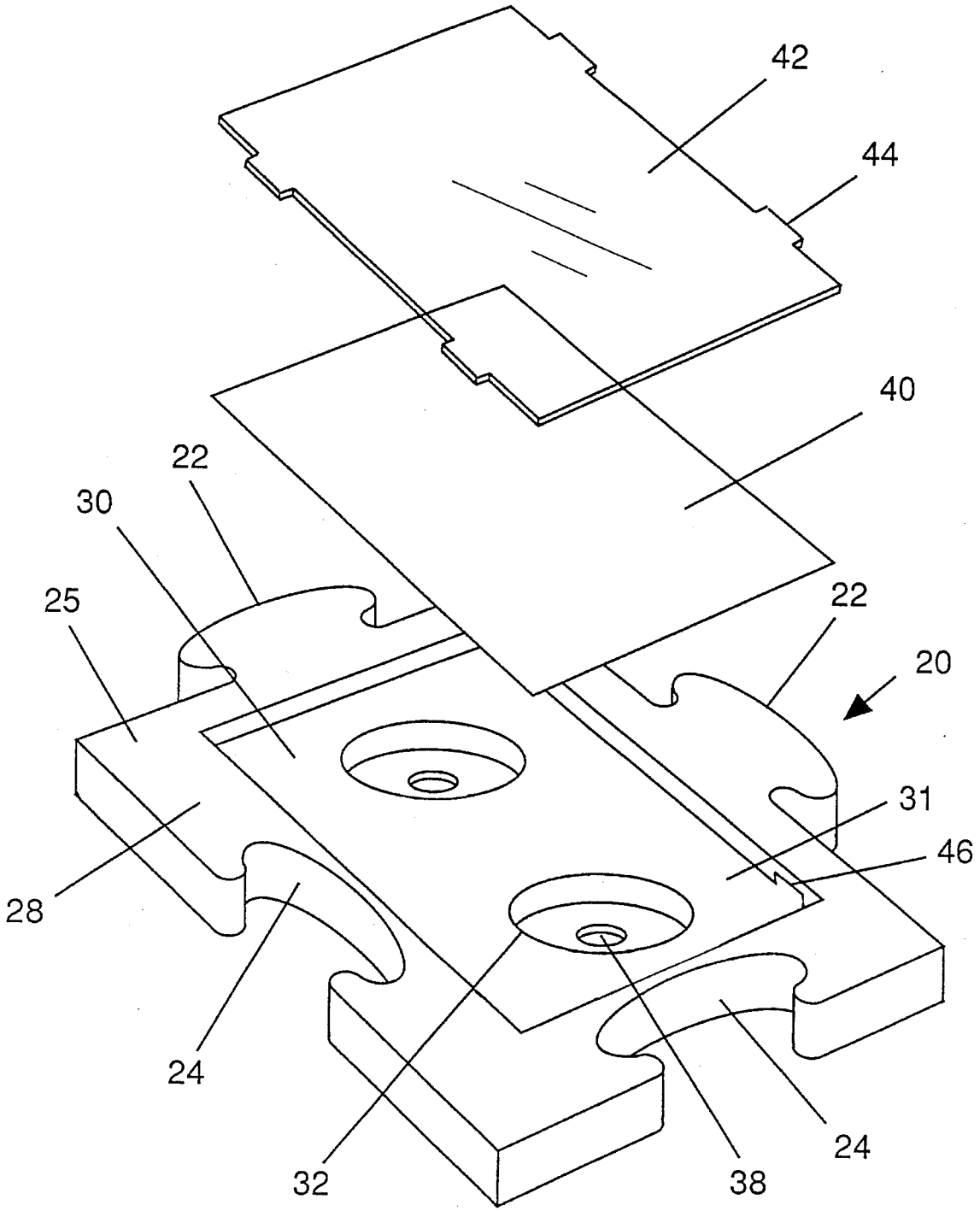

FIGS. 2A and 2B show exploded views of the picture frame 20. Both figures show the frame body 28, with the male 22 and female 24 connectors, as previously described. Located on the front face 25 of the frame body 28 there is a display recess 31 into which the item to be displayed 40 (photo, postcard, artwork, etc.) and the protective cover 42 fit. The display item 40 rests against the back 30 of the display recess 31. The protective cover has protrusions 44 which interlock with holes 46 in the sides of the display recess 31. The protective cover 42 is made of a flexible material which will bend relatively easily to allow the protrusions 44 to withdraw from the holes 46, for attaching and detaching the protective cover 42 to the frame. In this manner, the display item 40 can be quickly inserted, removed or changed. In the back 30 of the display recess 31 there is another deeper recess 34 (FIG. 2A), 32 (FIG. 2B). On the back wall 36 of this recess 34, 32 there is at least one attachment hole 38. If the frame 20 is to be hung where it mounts flush to the wall, a design such as FIG. 2A would be best. There are several attachment holes 38 which would completely fix the frame 20 to the wall. If less stability were necessary a design with two holes 38, as in FIG. 2B, or only one hole 38 would be sufficient and would not puncture the wall as many times as the design of FIG. 2A. The shape of the second recess 34, 32 may be any number of shapes, rectangular (FIG. 2A, 34), circular (FIG. 2B, 32), square, etc. The different shapes allow versatility of the attachment hole 38 placement, while each shape leaves enough of the back 30 of the display recess 31 to provide sufficient support of the display item 40.

The preferred material for the body 28 of the picture frame is an injection moldable plastic, such as polystyrene. However, other materials such as cast or machined plastic, metal or even wood can also be used in the construction of the frame. The frame body 28 can be molded in bright, decorative colors or it can be painted or decorated after molding. The protective cover 42 should be made of a clear and slightly flexible plastic material, such as polystyrene or acrylic.

Figure 3C:
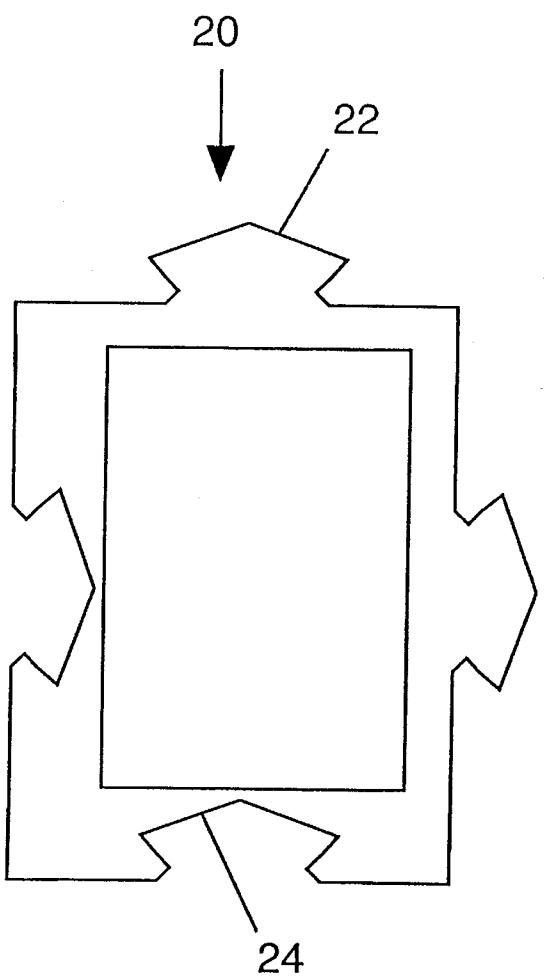
FIG. 3C is a top view of a third embodiment.
Figure 3B:
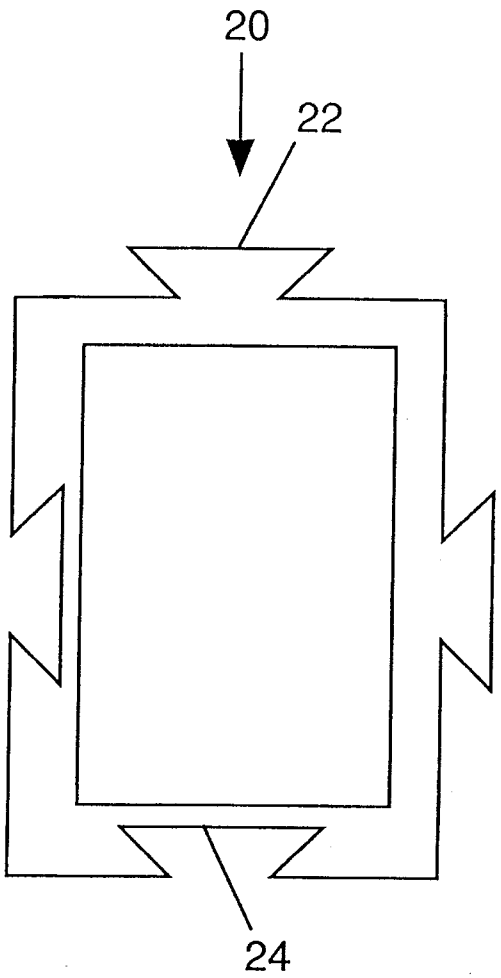
FIG. 3B is a top view of a second embodiment.
Figure 3A:
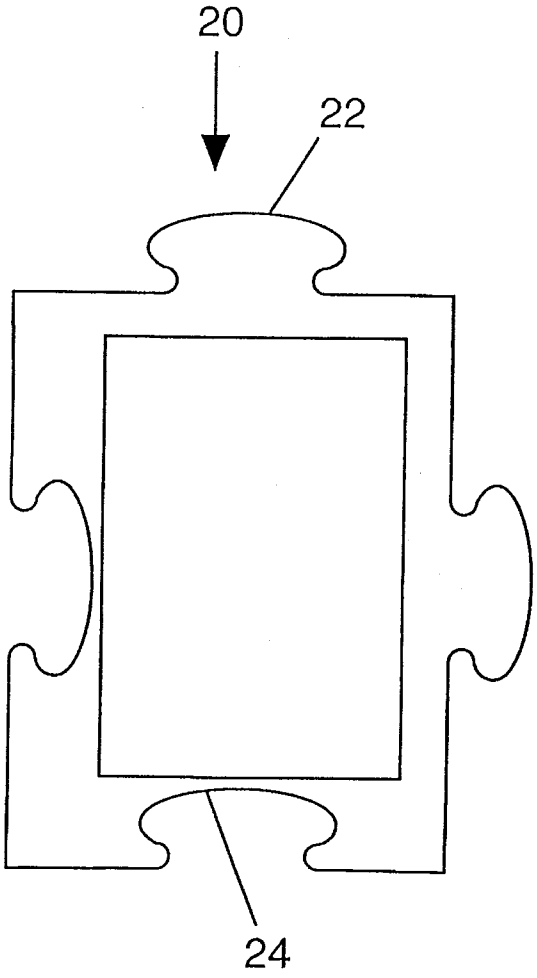
FIG. 3A is a top view of the first embodiment.

FIGS. 3A, 3B, and 3C are top views of different embodiments of the frame 20. FIG. 3A shows the first embodiment of the frame 20 with the rounded lobe-shaped connectors 22, 24 similar to jigsaw puzzle pieces. 5FIG. 3B shows a variation of the frame 20 with male connectors 22 and female connectors 24 shaped like dovetail connectors. In FIG. 3C the connectors 22, 24 are a more generic polygonal geometric shape. These are just a few examples of the many possible shapes for the male 22 and female 24 connectors. The frames 20 can be made in sets of matching frames with identical connectors 22, 24 so that the frames can be arranged in any desired pattern. Alternatively, the frames can be made in sets having slightly different connectors on each frame that only allow the frames to be assembled in one predetermined arrangement similar to an actual jigsaw puzzle.

Figure 4:
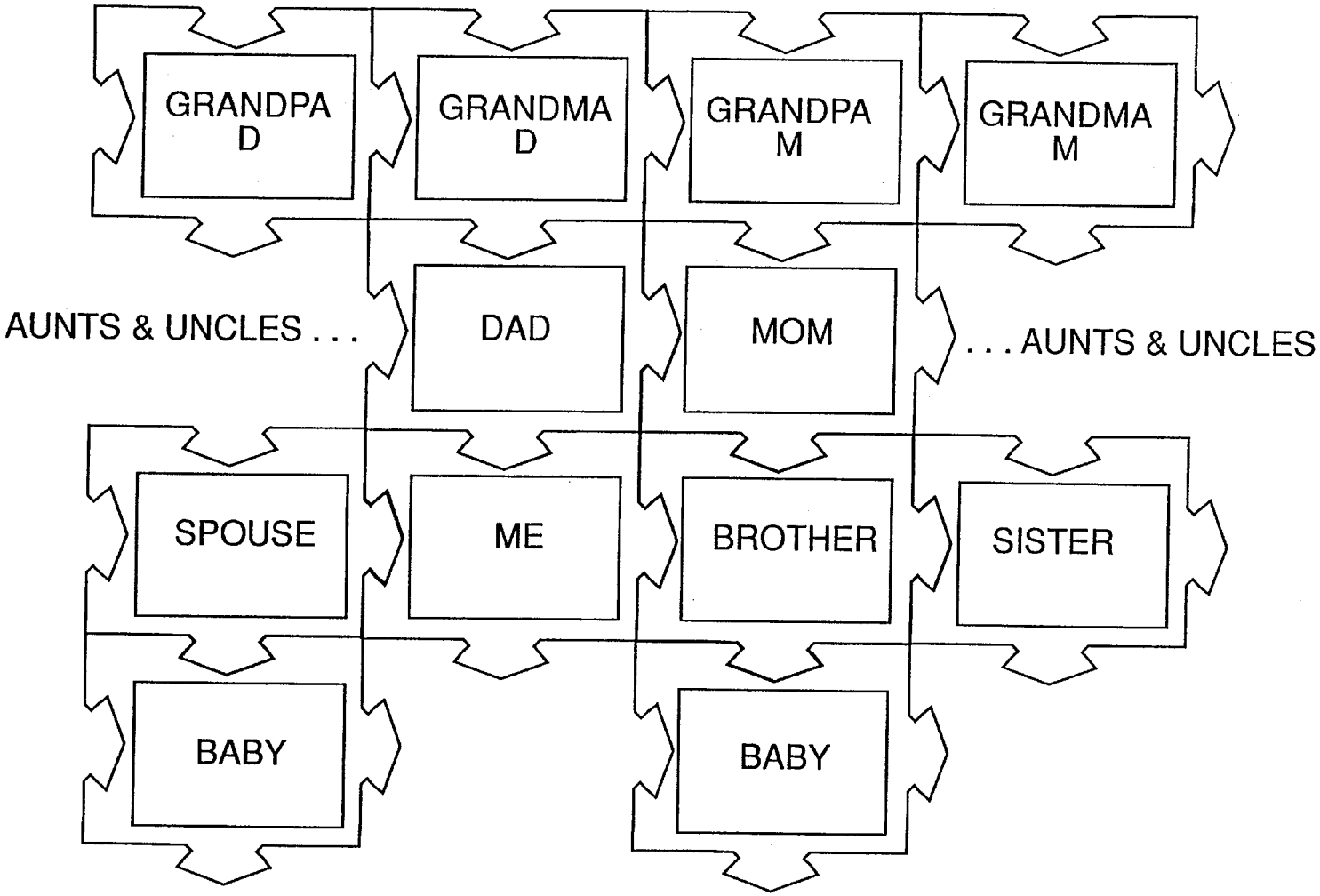
FIG. 4 shows several frames assembled together to depict a family tree.
Figure 5:
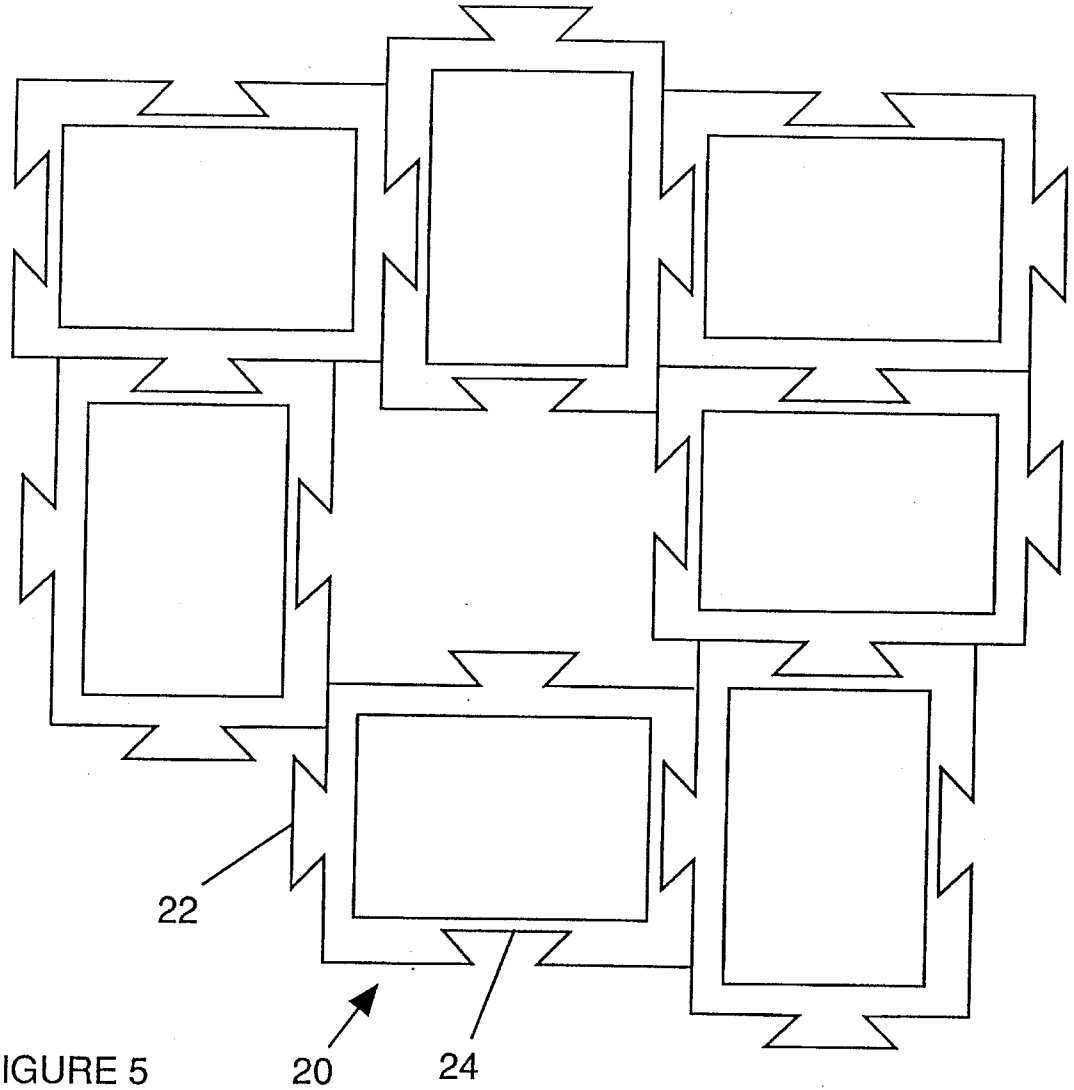
FIG. 5 shows a possible assemblage of several frames from FIG. 3B.

FIGS. 4 and 5 show possible assemblages of several frames. FIG. 4 shows the interlocking picture frame system arranged to depict a family tree. The connectors allow the pattern of frames to be expanded in any direction to add more photographs to the collection. A framing system that is modifiable is necessary in order to keep a family tree up to date throughout marriages and children. FIG. 5 shows a more random cluster arrangement of several frames with dovetail-shaped connectors. This illustrates the versatility of the interlocking picture frame system and the ability to arrange the frames together in almost any desired configuration.

Figure 6A:
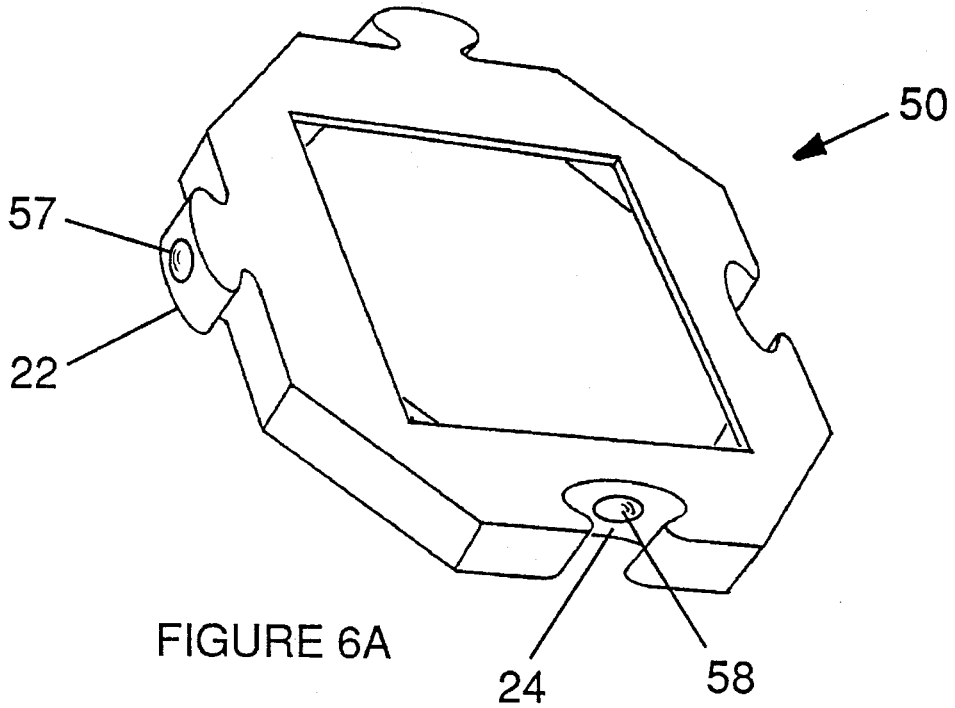
FIG. 6A and 6B show perspectives of an interlocking picture frame which is octagonally shaped.
Figure 6B:
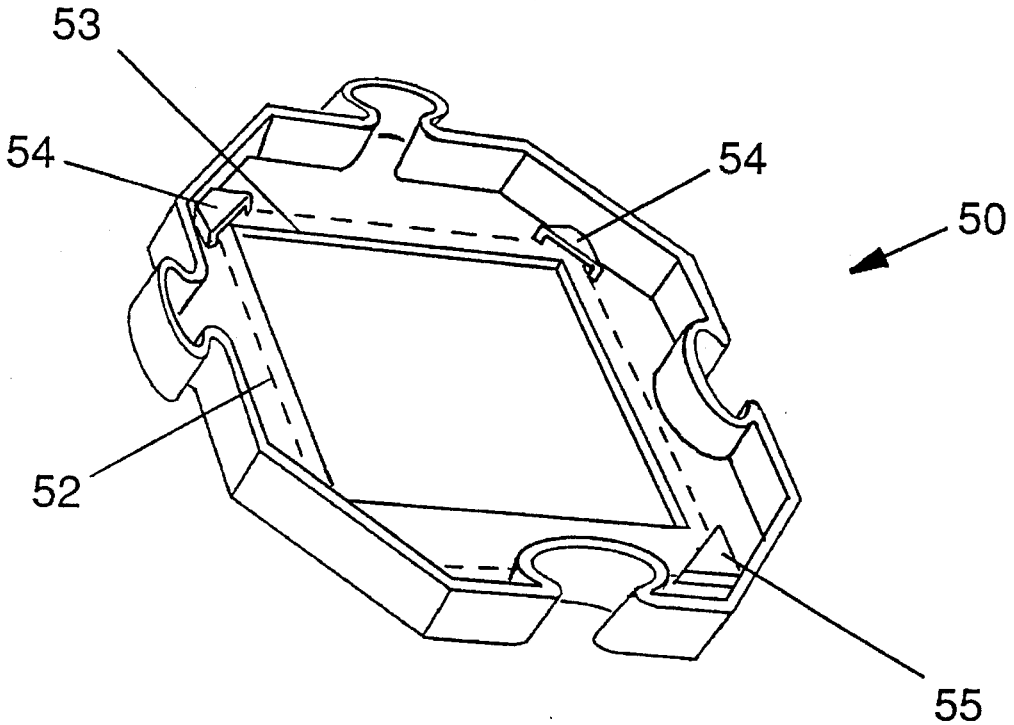

The frames 20 and connectors 22, 24 may be virtually any geometric shape, diamond, triangle, hexagon, they could even be curved or irregularly shaped as long as the connectors are allowed sufficient clearance to interlock. FIG. 6A shows a perspective view of an octagonally shaped picture frame 50 as one possible alternative. Any of the illustrated embodiments can be used to display standard rectangular or square photographs. Special modifications can also be made for displaying asymmetrical photographs, such as Polaroid instant photographs which typically have a wider border along one edge of the picture. FIG. 6*b* shows one such modification made to an octagonal frame 50, as seen from the back of the frame. In order to cover the unprinted border of the photograph 52, this embodiment allows the photo 52 to be back loaded into the frame 50 with the picture aligned with a display aperture 53 in the frame 50. The photo 52 is held in place by corner mounts 54, 55 under which the corners of the photo 52 slide. Because the border of an instant photograph is asymmetrical, the corner mounts 55 at the bottom of the frame are farther away from the display aperture 53 than the corner mounts 54 at the top of the frame. This insures that the picture on the photograph 52 is properly aligned with the display aperture 53. If a clear protective cover is used, it can be mounted in the corner mounts 54, 55 along with the photograph 52 or it can be permanently fixed in the display aperture 53 since the photograph 52 is back loaded into the frame 50.

FIG. 6A also shows the optional detents 57, 58 that can be included on the male 22 and female 24 connectors to form a more secure attachment between connected frames. The picture frame 50 is shown with a concave detent 57 on the end of the male connector 22, and a corresponding convex detent 58 on the inside of the female connector 24. When two adjacent frames are connected, the convex detent 58 pops into the concave detent 57, securely locking the two frames together. This is just one of the possible geometries. For instance, the positions of the concave 57 and convex 58 detents could be reversed or more than one detent could be used per connector.

Figure 7:
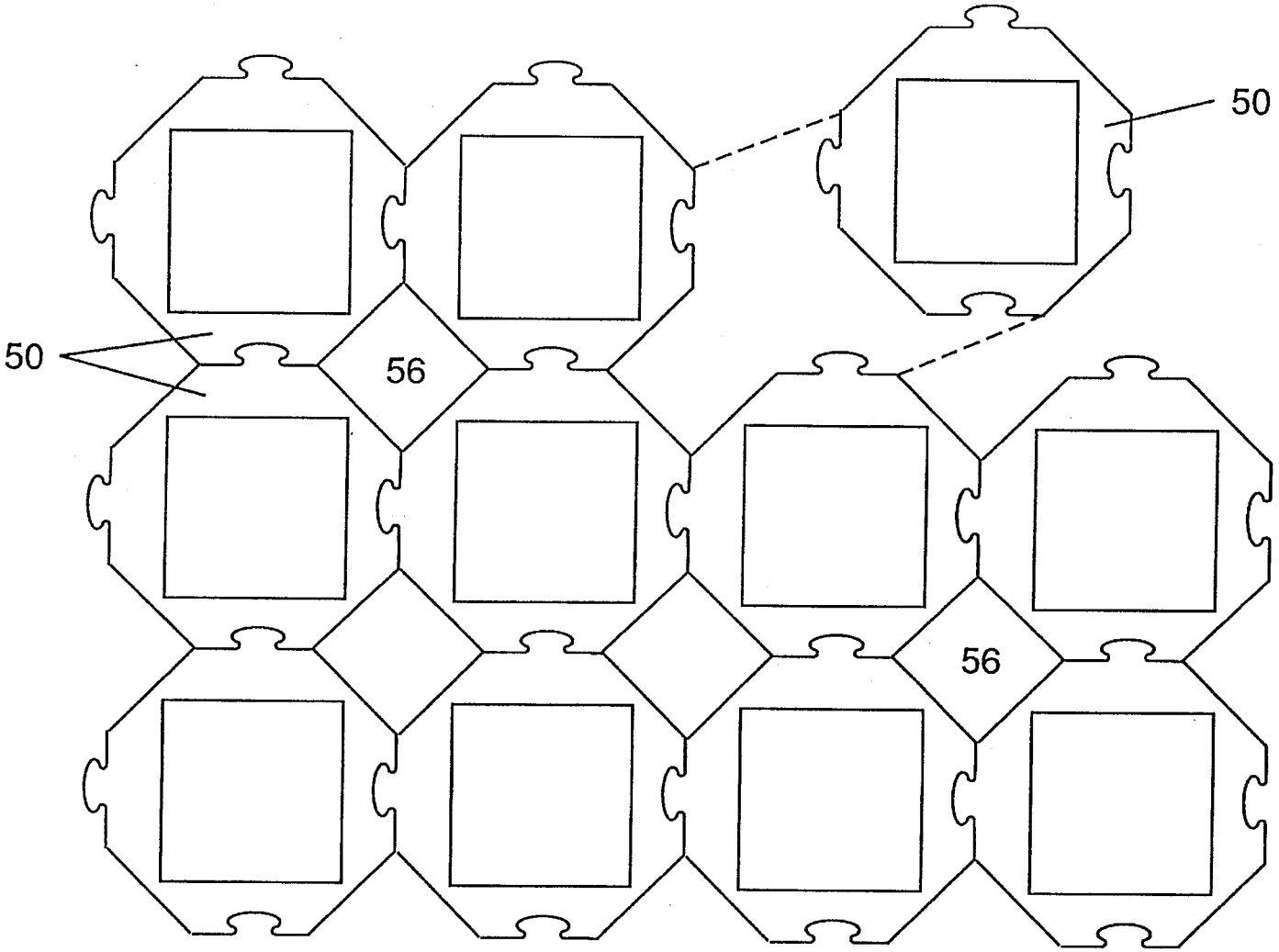
FIG. 7 shows a set of the octagonally shaped frames assembled together.

FIG. 7 shows a possible assembly of the octagonally shaped frames 50. This embodiment has the additional feature of leaving diamond shaped holes 56 between the frames which adds visual appeal to the arrangement.

Figure 8B:
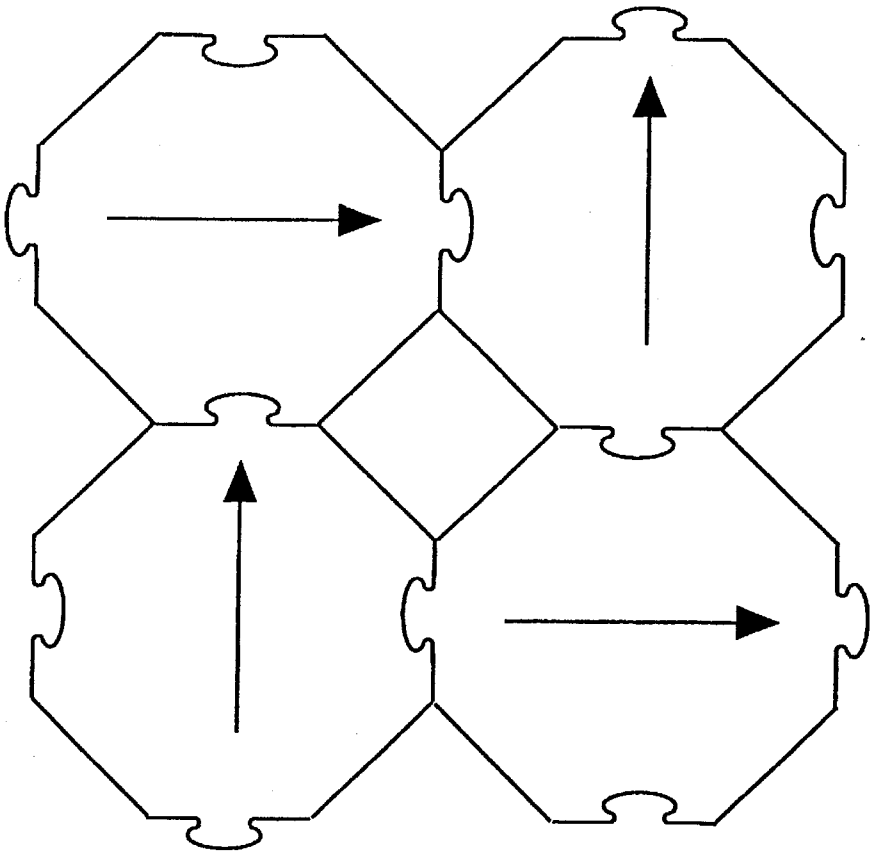
FIG. 8A–C show different arrangements of the connectors and photo display recesses.
Figure 8A:
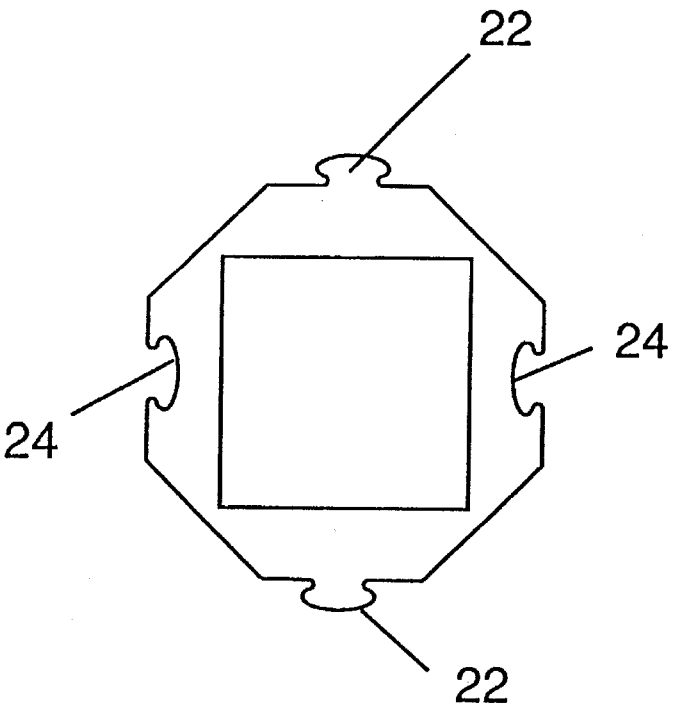
Figure 8D:
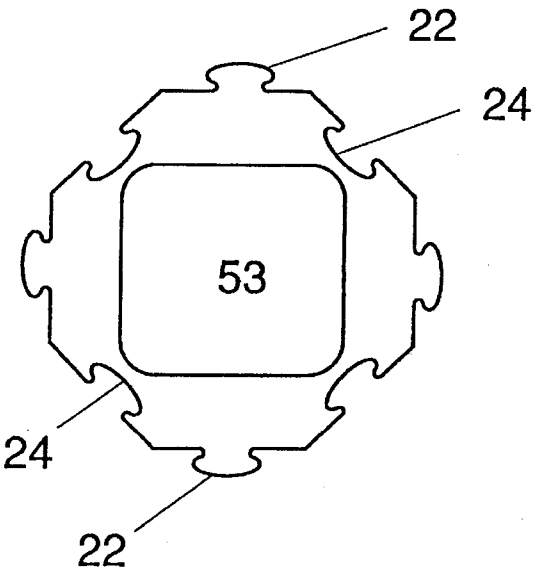
Figure 8C:
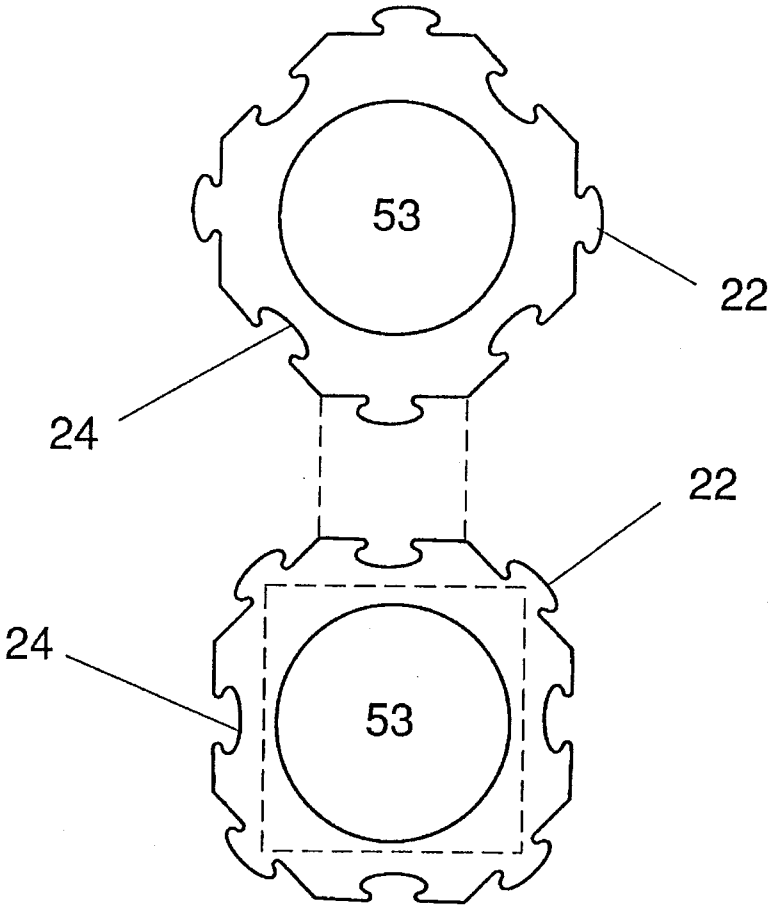

FIGS. 8A–C show variations of the octagonally shaped frame 50. FIG. 8A changes the position of the male and female connectors 22, 24. In the previously described embodiments, the frames were made so that the male connectors 22 and female connectors 24 were arranged in pairs 180 degrees apart. In FIG. 8A, two male connectors 22 are paired 180 degrees apart and two female connectors 24 are paired 180 degrees apart from one another and at 90 degrees to the male connectors. This imparts a subtle difference in how the frames interconnect. As shown in FIG. 8B, every other frame must be rotated 90 degrees so that the frames will fit together in a space-filling pattern. Yet another variation would be to make half of the picture frames with all male connectors 22 and half of them with all female connectors 24. That way, the frames would have to be alternated to make a space-filling pattern of interconnected frames. Either of these variations could also be used with a square or rectangular frame, such as those illustrated in FIGS. 1–5 or with other shaped frames.

FIGS. 8C and 8D show another variation of the octagonal frame 50 with eight connectors 22, 24. The multiple connectors allow these frames to be arranged in many interesting space-filling patterns. Since the edge of the frame is decorated all around with the male and female connectors 22, 24, this embodiment adds even more visual appeal to a collage of photographs when the picture frames are interlocked. The frames may also be made with different shapes of display apertures 53, such as: square (FIG. 8A), circular (FIG. 8C), square with rounded corners (FIG. 8D), or any other desired shape.

Figure 9C:
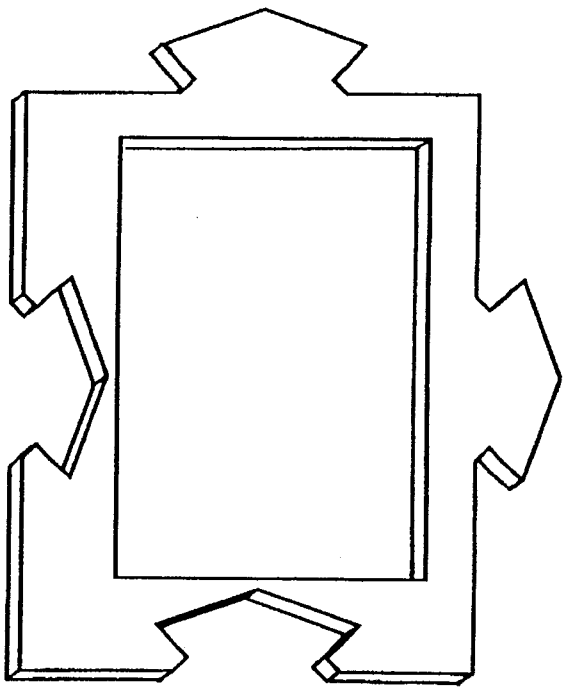
FIG. 9A–C show embodiments of the interlocking picture frame made of a magnetic sheet material.
Figure 9B:
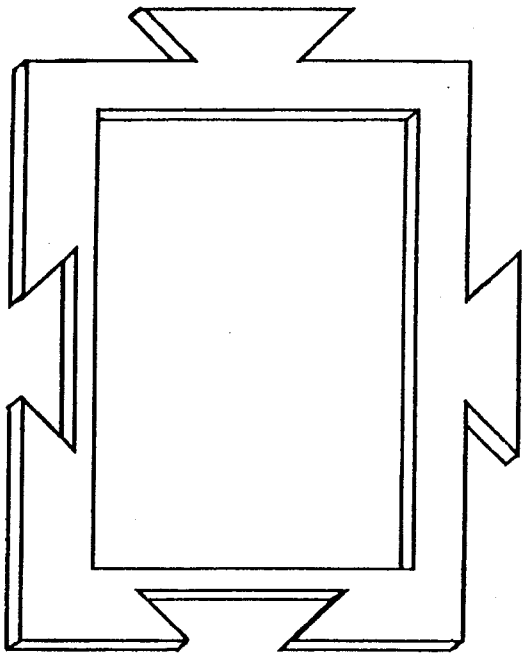
Figure 9A:
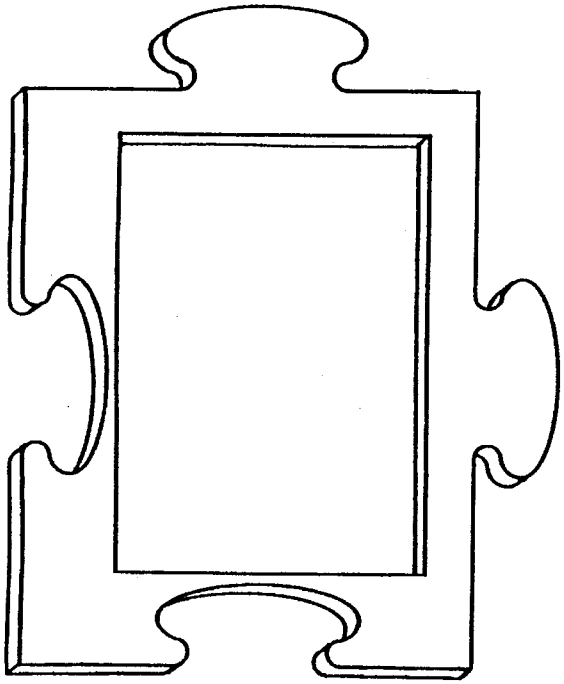

FIGS. 9A–C show embodiments of the interlocking picture frame made from a magnetic sheet material. The preferred material for this embodiment is a thin sheet of flexible rubberized magnetic material formed into picture frames in the shape of jigsaw puzzle pieces. Each puzzle piece-shaped frame has a display aperture for holding a photograph. The photographs can be adhesively attached to the frames from behind. Multiple frames can be arranged jigsaw puzzle-like on the metallic surface of a filing cabinet, refrigerator, or anything else magnetic. This embodiment of the interlocking frame system could be manufactured very inexpensively by die cutting the frames from rubberized magnetic sheets.

Although the examples given include many specificities, they are intended as illustrative of only some of the possible embodiments of the invention. Other embodiments and modifications will, no doubt, occur to those skilled in the art. For example, the frames can be made and sold in an assortment of colors, a rainbow set, or neon brites. The picture holding method may change. The picture may be loaded from the back with a fixed front protective sheet and a removable back plate. Thus, the examples given should only be interpreted as illustrations of some of the preferred embodiments of the invention, and the full scope of the invention should be determined by the appended claims and their legal equivalents.

I claim:

1. A picture frame, comprising;

a first frame body, said first frame body having a perimeter, said first frame body having at least one connector, said connector being selected from the group consisting of a male connector and a female connector, said male connector being a projection from said perimeter of said first frame body, said female connector being an indent in said perimeter of said first frame body, said first frame body having a front surface, and a display means for holding a display item for viewing, said display means comprises a first recess in said front surface for receiving said display item, and wherein said first recess comprises a back surface and a second recess within said back surface, said second recess having a back wall, said second recess having at least one hole through said back wall.

2. The picture frame of claim 1 further comprising a transparent cover means for covering said display item received in said first recess.

3. The picture frame of claim 1 further comprising an attachment means for affixing said first frame body in a desired location.

4. The picture frame of claim 1 wherein said first frame body has said back surface and a peripheral wall, said front surface being approximately parallel to said back surface, said peripheral wall being approximately perpendicular to said front surface and said back surface, said peripheral wall having a generally uniform height, said peripheral wall extending all the way around said first frame body including said at least one connector, said peripheral wall following the contour of said at least one connector.

5. The picture frame of claim 1 wherein said projection from said perimeter of said first frame body has a narrow neck connecting said projection to said first frame body, and said indent in said perimeter of said first frame body has a narrow throat.

6. The picture frame of claim 1 wherein said first frame body further comprises at least one additional connector, said additional connector being selected from the group consisting of an additional male connector and an additional female connector, said additional male connector being a projection from said perimeter of said first frame body, said additional female connector being an indent in said perimeter of said first frame body.

7. The picture frame of claim 1 wherein said male connector further comprises a detent means, and said female connector further comprises a corresponding detent means.

8. The picture frame of claim 1 wherein said first frame body comprises a plurality of said at least one connectors, each of said plurality of said at least one connectors being disposed in a different direction.

9. The picture frame of claim 8 wherein said picture frame has a generally rectangular shape having a top side, a bottom side, a right side, and a left side, said top having a first connector, said bottom side having a second connector, said right side having a third connector, said left side having a fourth connector.

10. A system of interlocking modular picture frames, comprising a first picture frame and a second picture frame, said first picture frame comprising:

a first frame body having a first front surface and having at least one male connector, said male connector being a projection from a side of said first frame body, a first display means for holding a first display item for viewing, said first display means comprising a first primary recess in said first front surface for receiving said first display item, said second picture frame comprising:

a second frame body having a second front surface and having at least one second female connector, said second female connector being an indent in a side of said second frame body, said indent being shaped to interlock with said projection of said male connector, a second display means for holding a second display item for viewing, said second display means comprising a second primary recess in said second front surface for receiving said second display item, whereby said first picture frame and said second picture frame are interlockable with one another by interlocking said male connector with said female connector, wherein said first primary recess comprises a first back surface and a first secondary recess within said first back surface, said first secondary recess having a first back wall, said first secondary recess having at least one hole through said first back wall, and wherein said second primary recess comprises a second back surface and a second secondary recess within said second back surface, said second secondary recess having a second back wall, said second secondary recess having at least one hole through said second back wall.

11. The system of interlocking modular picture frames of claim 10 wherein said first frame body has said first front surface and said first back surface and a first peripheral wall, said first front surface being approximately parallel to said first back surface, said first peripheral wall being approximately perpendicular to said first front surface and said first back surface, said first peripheral wall having a generally uniform height, said first peripheral wall extending all the way around said first frame body including said at least one male connector, said first peripheral wall following the contour of said at least one male connector, and wherein said second frame body has said second front surface and said second back surface and a second peripheral wall, said second front surface being approximately parallel to said second back surface, said second peripheral wall being approximately perpendicular to said second front surface and said second back surface, said second peripheral wall having a generally uniform height, said second peripheral wall extending all the way around said second frame body including said at least one female connector, said second peripheral wall following the contour of said at least one female connector.

12. The system of interlocking modular picture frames of claim 11 wherein said projection from the side of said first frame body has a narrow neck connecting said projection to said first frame body, and said indent in the side of said second frame body has a narrow throat, said narrow throat being shaped to interlock with said narrow neck, thereby interlocking said projection with said indent.

13. The system of interlocking modular picture frames of claim 10 wherein said first picture frame is formed in a shaped of a first jigsaw puzzle piece, and wherein said second picture frame is formed in a shape of a second jigsaw puzzle piece.

14. The system of interlocking modular picture frames of claim 10 wherein said first picture frame and said second picture frame further comprise at least one additional connector means, each of said connector means of said first picture frame and said connector means of said second picture frame being selected from the group consisting of an additional male connector and an additional female connector.

15. The system of interlocking modular picture frames of claim 10 wherein said male connector further comprises a detent means for interlocking with said female connector, and said female connector further comprises a corresponding detent means for interlocking with said male connector.

* * * * *